US008529152B1

(12) United States Patent
Thiesse et al.

(10) Patent No.: US 8,529,152 B1
(45) Date of Patent: Sep. 10, 2013

(54) RESISTIVE BRAKING VIA SCREED HEATING

(75) Inventors: Ryan T. Thiesse, Otsego, MN (US); Toby A. Frelich, St. Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 13/432,645

(22) Filed: Mar. 28, 2012

(51) Int. Cl.
*E01C 23/14* (2006.01)

(52) U.S. Cl.
USPC ..... 404/79; 404/84.1; 404/95; 404/118

(58) Field of Classification Search
USPC ..... 404/79, 84.05, 84.1, 95, 118
See application file for complete search history.

(56) References Cited

U.S. PATENT DOCUMENTS

| | | | | |
|---|---|---|---|---|
| 6,981,820 | B2 * | 1/2006 | Nelson | 404/118 |
| 8,356,958 | B2 * | 1/2013 | Braun et al. | 404/101 |
| 2006/0045624 | A1 * | 3/2006 | Nelson | 404/95 |

FOREIGN PATENT DOCUMENTS

JP 2010101141 A 5/2010

* cited by examiner

*Primary Examiner* — Gary Hartmann
(74) *Attorney, Agent, or Firm* — Miller, Matthias & Hull

(57) ABSTRACT

A method and various apparatus are provided for assisting braking in a paving machine having hydraulically driven ground engaging elements driven by a hydraulic motor, and one or more screed electrical heating elements powered by a generator. In the event that the application of the machine deceleration system occurs at a machine speed exceeding a predetermined threshold value, the hydraulic motor of the drive train is configured to drive the hydraulic pump of the hydraulic system. The hydraulic pump is linked to the system generator to generate electrical power to drive the one or more screed electrical heating elements at a current greater than the current previously being provided to the one or more screed electrical heating elements.

19 Claims, 6 Drawing Sheets

RESISTIVE BRAKING VIA SCREED HEATING

TECHNICAL FIELD OF THE DISCLOSURE

The present disclosure relates to paving machines and, more particularly, relates to braking of paving machines via screed plate heating.

BACKGROUND OF THE DISCLOSURE

Asphalt roadways are generally constructed by laying heated paving material, such as bituminous aggregate mixtures or asphalt onto a roadbed. After the heated asphalt is laid, it is typically spread, leveled and compacted such that upon cooling, a road with a uniform, smooth surface that is passable by vehicles is achieved. In order to spread the heated asphalt, a paving machine, known as a screed, may be used. Such screeds can be pulled by a tractor, truck or the like or can be self-propelled. The truck or the tractor supplies the asphalt and the screed then heats, vibrates and manipulates the asphalt into a smooth uniform surface. A screed generally employs a screed assembly having one or more separable screed units.

The screed may represent a significant portion of overall machine mass, and may thus have a substantial effect on machine braking performance. In particular, a tractor or other pulling machine coupled to multiple filled screeds may have difficulty meeting minimum stopping time/maximum stopping distance requirements due to the additional mass of the screeds and their contents. Therefore, additional braking capabilities beyond those provided by the decelerations of the tractor or truck may be needed.

It is possible to extract additional energy from the machine motion via a hydraulic drive circuit linked to the machine wheels. In this arrangement, the hydraulic fluid would absorb the excess energy not extracted by the decelerations, slowing the machine, with the excess energy then being dissipated from the hydraulic fluid via a radiator or other means. However, the heat cycling of the hydraulic fluid may negatively impact fluid life and may also at least temporarily degrade fluid performance, leading to reduced performance as well as a requirement for more frequent fluid replacement. Moreover, the hydraulic fluid may have a maximum heat capacity that is less than that required to effectively stop the machine under more challenging circumstances. In short, mechanisms for extracting and dissipating excess paving machine speed have not, to date, been entirely acceptable.

It will be appreciated that this background section was created by the inventors for the reader's convenience, and is meant to discuss problems and solutions noted by the inventors, not to discuss or explain prior art. Thus the inclusion of any problem or solution in this section is not an indication that the problem or solution is prior art.

SUMMARY OF THE DISCLOSURE

In accordance with one aspect of the present disclosure, a method is provided for assisting braking in a paving machine having hydraulically driven ground engaging elements driven by a hydraulic motor powered by a hydraulic pump, a machine deceleration system, and one or more screed electrical heating elements powered by a generator. In this embodiment, the method includes detecting application of the machine deceleration system when a machine speed exceeds a predetermined threshold value and, in response, causing the hydraulic motor to drive the hydraulic pump, causing the generator to generate electrical power therefrom, and driving the one or more screed electrical heating elements such that a current to the one or more screed electrical heating elements exceeds a current being provided to the one or more screed electrical heating elements at the time of detecting application of the machine deceleration system.

In accordance with another aspect of the present disclosure, a paving system is provided for laying a paving material on a roadbed. The paving system includes a tractor having an engine and a drive train, the drive train being driven by one or more hydraulic motors. A hydraulic supply system driven by the engine includes a hydraulic pump and one or more control valves for controlling the flow of hydraulic fluid to and from the one or more hydraulic motors. A machine deceleration system is selectively linked to the machine drive train. A screed assembly having one or more heating elements for heating the screed plate is included, as is an electrical generator configured to provide electrical power to the one or more heating elements. A controller linked to the electrical generator, hydraulic supply system, and machine deceleration system, is configured to cause energy to be transferred from the one or more hydraulic motors of the drive system to the hydraulic pump, from the hydraulic pump to the generator, and from the generator to the one or more heating elements in the event that application of the machine deceleration system occurs at a machine speed exceeding a predetermined threshold.

In accordance with yet another aspect of the present disclosure, a tractor for pulling a paving screed having one or more electrically powered screed heater elements is provided. The tractor includes an engine and a drive train, the drive train being driven by one or more hydraulic motors, as well as a hydraulic supply system driven by the engine. The hydraulic supply system includes a hydraulic pump and one or more control valves for controlling the flow of hydraulic fluid to and from the one or more hydraulic motors. A machine deceleration system is selectively linked to the machine drive train. The tractor also includes an electrical generator configured to provide electrical power to the one or more heating elements and a controller linked to the electrical generator, hydraulic supply system, and machine deceleration system, configured to cause energy to be transferred from the one or more hydraulic motors of the drive system to the hydraulic pump, from the hydraulic pump to the generator, and from the generator to the one or more heating elements in the event that application of the machine deceleration system occurs at a machine speed exceeding a predetermined threshold.

While the present disclosure is susceptible to various modifications and alternative constructions, certain illustrative embodiments thereof will be shown and described below in detail. It should be understood, however, that there is no intention to be limited to the specific embodiments disclosed; on the contrary, the intention is to cover all modifications, alternative constructions, and equivalents along within the spirit and scope of the present disclosure.

DETAILED DESCRIPTION OF THE DISCLOSURE

Figure 1:
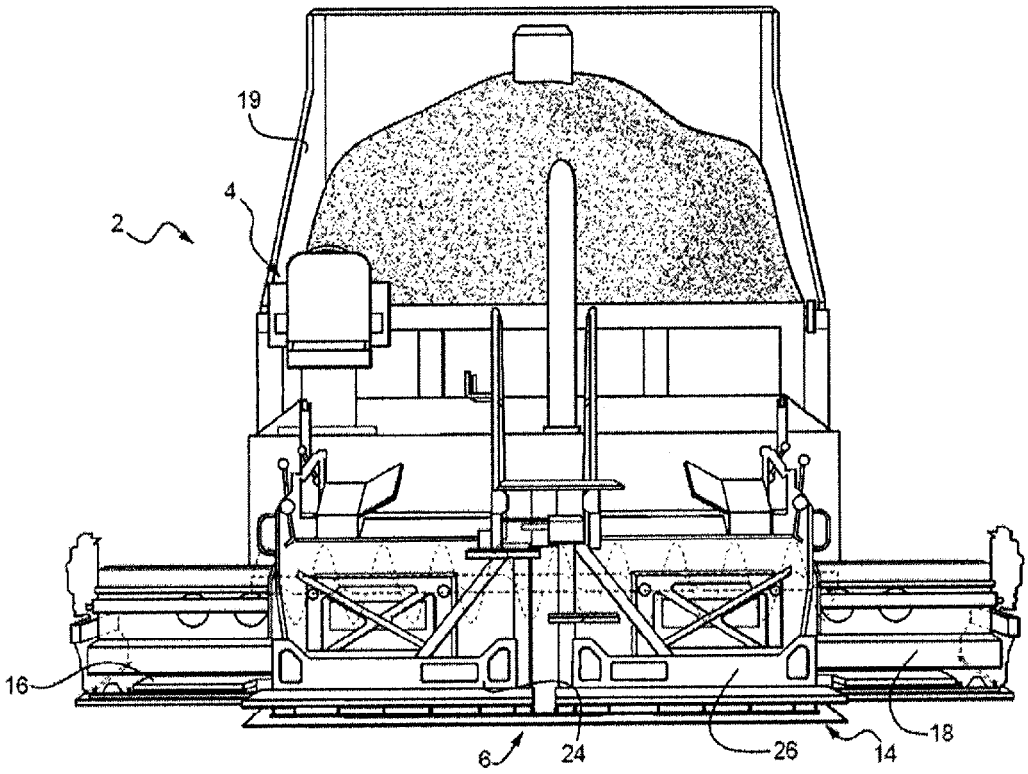
FIG. 1 is a perspective view of an exemplary screed with respect to which embodiments of the present disclosure may be implemented.

The present disclosure provides a system and method for the braking of paving machines via hydroelectric screed plate heating. Referring now to FIG. 1, an exemplary paving system 2 is schematically shown, in accordance with one or more embodiments of the present disclosure. It will be understood that only those components that are helpful for a proper understanding of the present disclosure are shown and/or described herein. Nevertheless, several other components that are commonly employed in combination or conjunction with such paving machines are contemplated and considered within the scope of the present disclosure.

In the illustrated embodiment, the paving system 2 includes a tractor 4 towing a screed assembly 6. The tractor 4 may include an engine, a transmission and wheels, tracks or other locomotive devices for moving the tractor 4 and coupled screed assembly 6. In an embodiment, the engine drives a hydraulic pump to generate pressurized hydraulic fluid used to propel the tractor 4 via one or more hydraulic motors. Moreover, the tractor 4 may include a hopper 19 for receiving and temporarily storing a supply of asphalt, as well as feeder conveyors or augers for moving the asphalt from the hopper 19 to the screed assembly 6. Once the asphalt reaches the screed assembly 6, the screed assembly 6 may level and shape the asphalt into a layer of desired thickness, size and uniformity for deposit on the roadbed or proceeding road layer. To do so, the screed assembly 6 may employ leveling arms, mold boards, and vibrators, which for conciseness of expression are not described herein.

The screed assembly 6 may include a main screed plate 14 and left and right extenders 16 and 18. The main screed plate 14 may further include left and right main screed elements 24 and 26, respectively. The left extender 16 may be connected to the left of the left main screed element 24 and the right extender 18 may be connected to the right of the right main screed element 26. In at least some embodiments, each of the left and the right extenders 16 and 18, respectively, may be mounted in front or rear of the main screed plate 14 in a manner commonly employed and may be hydraulically controlled. Notwithstanding the fact that in the illustrated embodiment, numerous screed elements (the left main screed element 24, the right main screed element 26, the left extender 16, the right extender 18, etc.) of the screed assembly 6 have been shown, in at least some embodiments, the number of these sections may vary depending particularly upon the width of the paving area.

Figure 2:
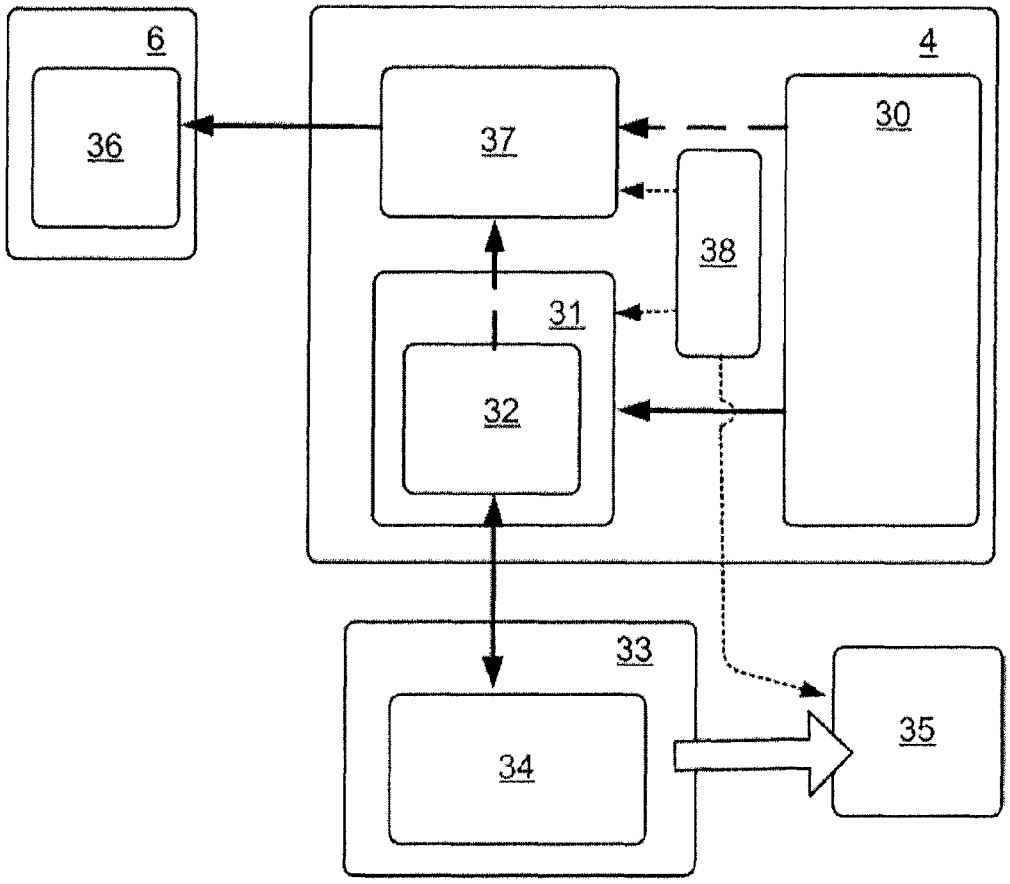
FIG. 2 is a system schematic showing power sources and drains within a paving system in accordance with at least some embodiments of the present disclosure.

Referring now to FIG. 2, this figure is a system schematic showing power sources and drains within the paving system 2, as well as control channels to the extent useful to understanding the present disclosure. As can be seen, the paving system 2 includes within the tractor 4 an engine 30 and a hydraulic supply system 31 driven by the engine 30. The hydraulic supply system 31 includes primarily a hydraulic pump 32 as well as one or more control valves for controlling the flow of hydraulic fluid to and from the machine drive train 33.

The machine drive train 33 includes one or more hydraulic motors 34 configured to propel the tractor 4 of the paving system 2. Thus, power supplied by the engine 30 may be provided to drive the hydraulic pump 32 of the hydraulic supply system 31. In turn, the hydraulic pump 32 provides pressurized fluid to drive the one or more hydraulic motors 34 of the machine drive train 33.

For braking the tractor 4 and thus the entire paving system 2 under normal operating conditions, a machine deceleration system 35 is selectively linked to the machine drive train 33. The machine deceleration system 35 includes one or more facilities for allowing the operator to command a slowing of the machine. These include one or more of: a rocker or toggle switch or other binary input having a first position indicating the machine is to move and a second position indicating the machine is to stop; a joystick that can be displaced from a neutral position to a variety of forward speed positions, and a deceleration pedal, sometimes referred to as a "decel pedal."

Thus, for example, when braking is required during normal operating conditions pursuant to one or more elements of the machine deceleration system 35, the hydraulic pump 32 is destroked and stops the provision of pressurized fluid to the one or more hydraulic motors 34 of the machine drive train 33, and the deceleration system 35 extracts translational energy from the drive train (and thus from the entire paving system 2) via frictional or other interaction with the machine drive train 33.

However, the machine deceleration system 35 has a finite capacity for extracted energy as well as a finite rate at which it is able to extract energy, and as such the ability of the machine to slow via the machine deceleration system 35 is limited. As such, it may be difficult or impossible under extreme conditions, such as during high speed movement of a heavily loaded paving system 2, to bring the paving system 2 to a full stop within required distances and/or times.

As noted above, the paving system 2 includes a screed assembly 6 having therein one or more heaters for heating asphalt prior to laying the asphalt on the roadbed or prior paving layer. In an embodiment, the one or more heaters of the screed assembly 6 are heated via electrical resistive heating elements 36, which receive electrical power from an electrical generator 37. The electrical generator 37 is in turn driven by the engine 30 via the hydraulic pump 32 or via mechanical means such as a belt, gear train, etc. Alternatively, the electrical generator 37 may be linked, e.g., via a hydraulic connection, to the hydraulic pump 32 itself.

A controller 38 is communicatively linked to the electrical generator 37, hydraulic supply system 31, and the deceleration system 35, and is configured, as will be discussed in greater detail below, to coordinate energy transfer through these elements. In this way, translational energy of the paving system 2 may be extracted by the deceleration system 35 alone during normal conditions, and may be further extracted under extreme conditions by allowing the hydraulic pump 32 acting as a hydraulic motor driven by the machine drive train 33 to drive the electrical generator 37 and dissipate electrical energy thus generated through the electrical resistive heating elements 36 of the screed assembly 6, dissipating the energy as heat.

In one or more embodiments, the controller 38 is implemented as a computing device incorporating one or more microcontrollers and/or microprocessors (collectively referred to herein as the "processor" or "digital processor"). The processor operates by reading computer-executable instructions, or code, from a nontransitory computer-readable medium such as a nonvolatile memory, a magnetic or optical disc memory, a flash drive, and so on. It will be appreciated that data used by the processor in the execution of the computer-executable instructions may be stored and read out as well. The controller 38 has one or more interfaces to receive data and/or commands, and one or more outputs to output data and/or commands.

The generator 37 may be any of a variety of alternating current (AC) or direct current (DC) generators that are commonly employed in paving machines. The generator 37 may be linked to the electrical resistive heating elements 36 of the screed assembly 6 via any suitable means.

Although the controller 38 and the generator 37 are shown as being housed within the tractor 4 of the paving system 2, this is not required in every embodiment. Rather, in other embodiments, one or both of the controller 38 and the generator 38 may be located off-board from the tractor 4. In an alternative embodiment, the controller 38 is located in a remote location for controlling the generator 38 and relays as needed.

Figure 3:
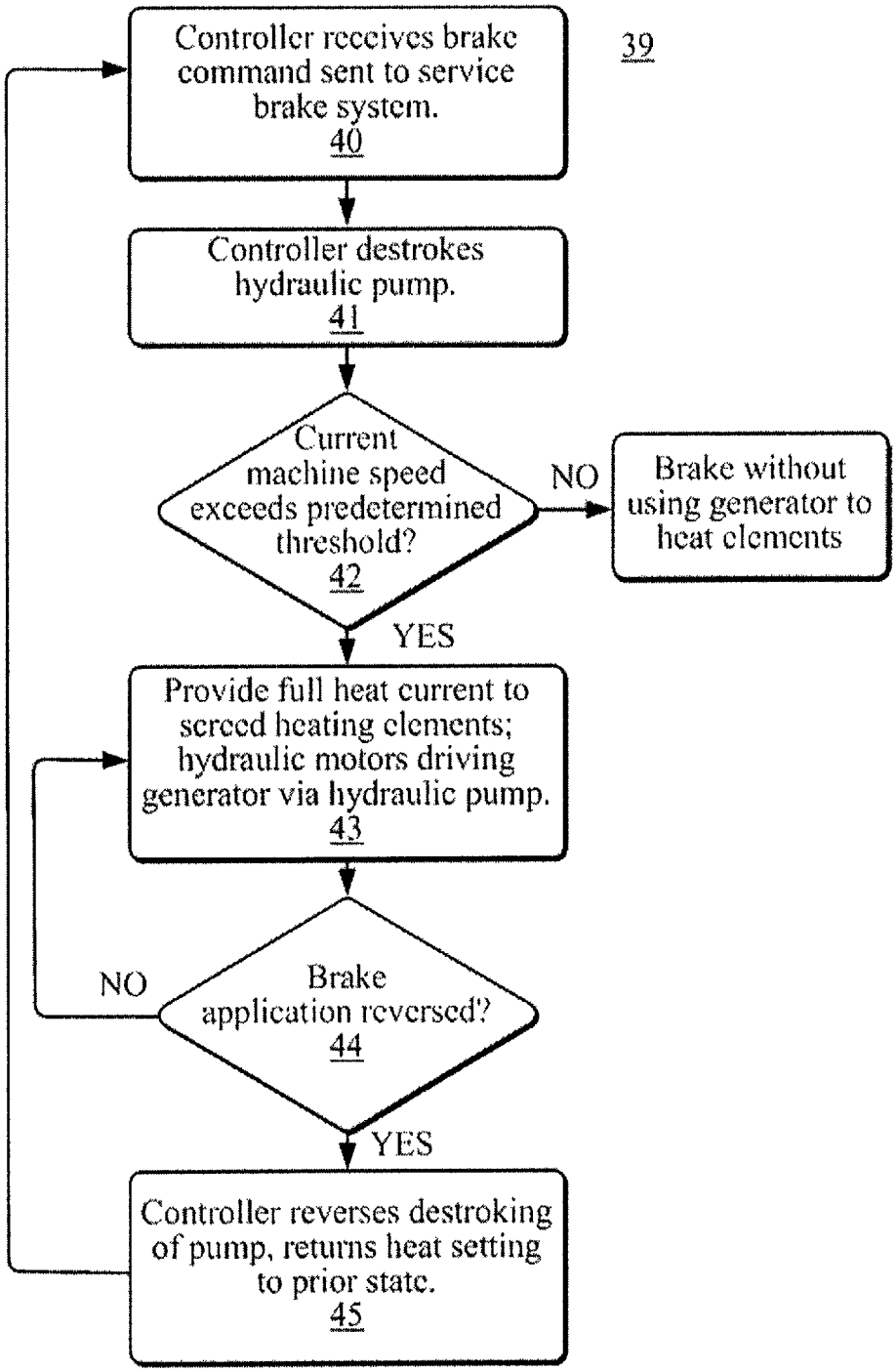
FIG. 3 is a flow chart showing an exemplary process of providing a braking assist to a paving system via screed heating, in accordance with at least some embodiments of the present disclosure.

Referring now to FIG. 3, a braking process 39 implemented by the controller 38 for dissipating energy through the electrical resistive heating elements 36 of the screed assembly 6 is shown, in accordance with at least some embodiments of the present disclosure. As shown, at stage 40 of the braking process 39, the controller 38 receives a brake command sent by the deceleration system 35. At stage 41, the controller 38 destrokes the hydraulic pump 32 to begin slowing the machine and proceeds to stage 42.

At stage 42 of the braking process 39, the controller 38 determines whether the current machine speed exceeds a predetermined threshold speed, e.g., 15 kph or other suitable speed. If it is determined at stage 41 that at the time the brake command is received the machine speed does not exceed the predetermined threshold speed, the process 39 terminates and braking occurs without using the generator 37 to heat the screed assembly 6.

If instead it is determined at stage 42 that the current machine speed exceeds the predetermined threshold speed, the braking process 39 proceeds to stage 43, wherein the controller 38 signals the generator 37 and/or associated relays or switches to provide full heat current to the electrical resistive heating elements 36 of the screed assembly 6. With the hydraulic pump 32 destroked, the pump is driven as a motor by machine momentum, and in turn powers the generator 37 through the common connection of the engine 30. In other words, the rotation of the hydraulic motors 34 of the drive train 33 powers the hydraulic pump 32 as a hydraulic motor, and the rotation of the hydraulic pump 32 serves to power the rotation of the generator 37. The excess electrical power generated by the rotation of the generator 37 is absorbed by the heating of the electrical resistive heating elements 36 of the screed assembly 6.

During the time that the braking command is in force, the operation of the system elements remains as set in stages 41 and 43. However, if the braking command is reversed at stage 44, the dissipation of energy through the electrical resistive heating elements 36 of the screed assembly 6 is no longer needed, and the controller 38 at stage 45 reverses the destroking of the hydraulic pump 32 and returns the heat setting of the electrical resistive heating elements 36 of the screed assembly 6 to their prior state.

Figure 4:
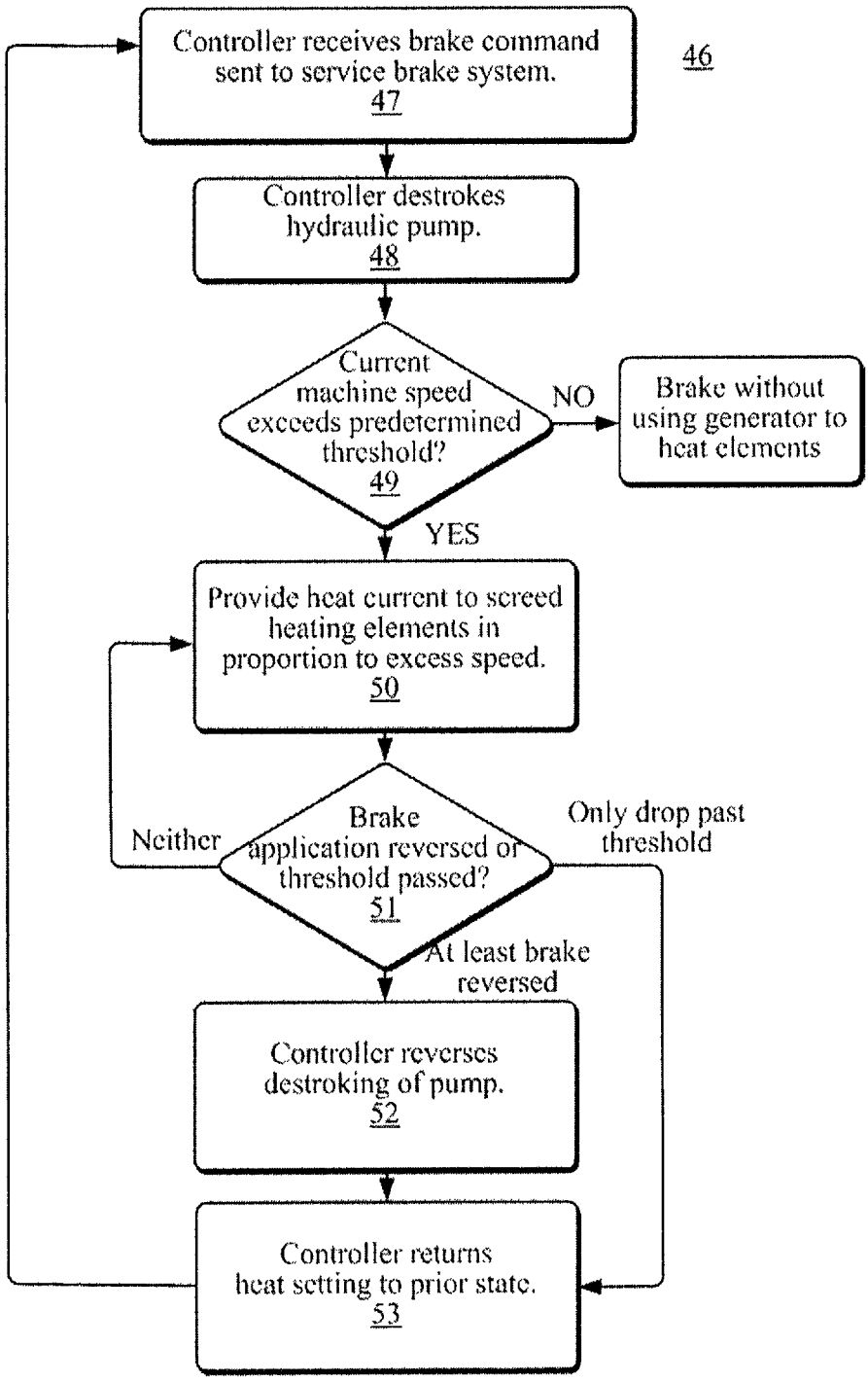
FIG. 4 is a flow chart showing an alternative process of providing a braking assist to a paving system via screed heating, in accordance with at least some embodiments of the present disclosure.

In an alternative embodiment, the controller 38 utilizes the energy dissipation of capacity of the electrical resistive heating elements 36 of the screed assembly 6 to assist braking in a graduated fashion. A second braking process 46 in accordance with this embodiment is shown in the flowchart of FIG. 4. At stage 47 of the second braking process 46, the controller 38 receives a brake command from the deceleration system 35. At stage 48, as with the prior embodiment, the controller 38 destrokes the hydraulic pump 32 to begin slowing the machine and proceeds to stage 49.

At stage 49 of the braking process 46, the controller 38 determines whether the current machine speed exceeds a predetermined threshold speed. If the machine speed does not exceed the predetermined threshold speed, the process 46 terminates and braking occurs without using the generator 37 to heat the screed assembly 6, and otherwise the process 46 moves forward to stage 50. At stage 50, the controller 38 signals the generator 37 and/or associated relays or switches to provide heat current to the electrical resistive heating elements 36 of the screed assembly 6 in proportion to the extent by which the machine speed exceeds the predetermined threshold speed.

In an embodiment, the amount of additional current is calculated such that after provision of the additional current, the range of machine speed capacity beyond the current speed maps to the range of remaining current increase available prior to reaching a maximum available or permissible current. Thus, when the machine is at full speed and deceleration is requested, the maximum allowed heating current is provided to the electrical resistive heating elements 36, and for lesser amounts of excess speed, proportionally less current is provided to the electrical resistive heating elements 36, such that as the machine speed is reduced to the threshold, the additional current supplied to the electrical resistive heating elements 36 reaches zero. In an alternative embodiment, any level of deceleration triggers a dumping of all available excess energy, through the generator 37, to the screed plate 14.

From stage 50, the process 46 proceeds to stage 51 where it is determined whether the deceleration command has ceased or the machine speed has dropped below the threshold. If neither has occurred, the process 46 returns to stage 50. If at least the braking command has ceased, then the controller 38 reverses the destroking of the hydraulic pump 32 at stage 52, returns the heat setting of the electrical resistive heating elements 36 of the screed assembly 6 to their prior state at stage 53, and then returns to stage 47. If the brake command remains in force but the machine speed drops below the threshold, the process 46 skips stage 52 and proceeds to stage 53.

INDUSTRIAL APPLICABILITY

In general, the present disclosure sets forth a control system for supplementing the braking of the motion of a paving system by dissipating energy via heating of a screed assembly associated with the paving system. In particular, the disclosed system extracts the energy of machine motion through the machine hydraulic drive system, shunting that extracted energy to a generator, and dissipating the shunted energy via heating of the screed assembly heating elements. In an embodiment of the disclosed system, the dissipation of energy through the screed heating elements is implemented for speeds exceeding a predetermined threshold speed.

In a further embodiment, for brake applications at speeds exceeding the threshold, the screed heating elements receive full heating current, dissipating the maximum possible energy via heat. In an alternative further embodiment, for brake applications at speeds exceeding the threshold, the screed heating elements receive an incremental additional amount of heating current, such that brake application at maximum machine speed would result in the application of maximum heating current.

Figure 5:
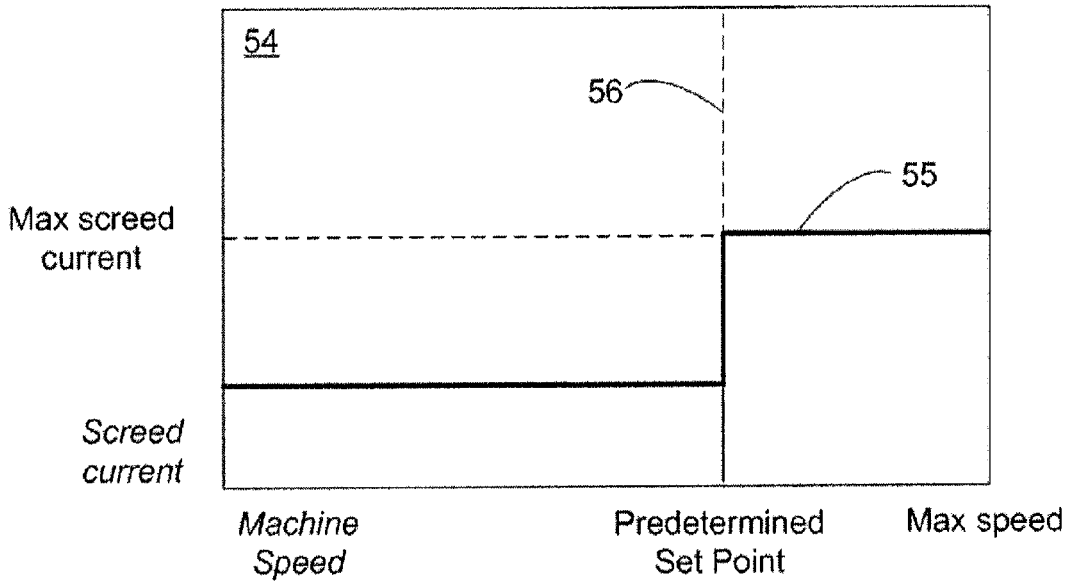
FIG. 5 is a data plot showing machine braking performance with a threshold triggered assist in accordance with at least a first embodiment of the present disclosure.

Turning now to FIG. 5, a graphical representation 54 shows the manner in which heating of the electrical resistive heating elements 36 of the screed assembly 6 is a function of machine speed to dissipate machine energy in an embodiment. Specifically, the graphical representation 54 plots the machine speed on the x-axis against screed current 55 on the y-axis. As can be seen, starting from zero machine speed, for brake applications at speeds up to the predetermined threshold value 56, the screed current is not affected by machine deceleration commands. Thus, the screed current 55 rests at a value selected by the operator for supporting current heating needs. For brake applications at machine speeds surpassing the threshold value 56, the screed current 55 increases in a step-wise manner at the threshold value 56 as the electrical resistive heating elements 36 of the screed assembly 6 receive full heating current to dissipate machine energy.

Figure 6:
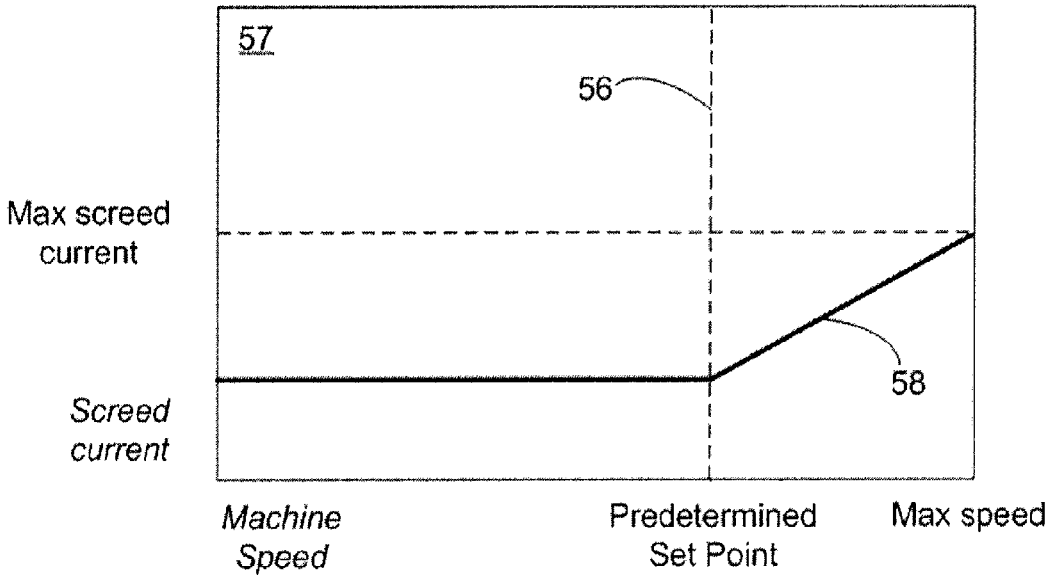
FIG. 6 is a data plot showing machine braking performance with a threshold triggered assist in accordance with at least an alternative embodiment of the present disclosure.

The braking plot 57 of FIG. 6 illustrates energy dissipation using the alternative scheme for braking assist noted above. In particular, the braking plot 57 shows the screed current response 58 of incremental brake assist starting at the same threshold value 56 as in the prior embodiment. However, rather than adding the braking assist of the electrical resistive heating elements 36 in a step-wise manner, the current to the electrical resistive heating elements 36 is increased smoothly to the maximum screed current as the machine speed at which deceleration is requested increases to its maximum.

It will be appreciated that the present disclosure provides an effective and efficient mechanism and control system for assisting machine braking by extracting hydraulic energy, converting it to electrical energy, and dissipating the electrical energy via heating the electrical resistive heating elements 36 of the screed assembly 6. Not only do the described system and method generally improve braking performance for paving systems under extreme conditions, but they also provide potential energy savings since normally wasted energy can be used to heat elements of the system that must be heated to function in any case.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A method of assisting braking in a paving machine having hydraulically driven ground engaging elements driven by a hydraulic motor powered by a hydraulic pump, a machine deceleration system, and one or more screed electrical heating elements powered by a generator, the generator being linked to the hydraulic pump, the method comprising:

detecting application of the machine deceleration system when a speed of the machine exceeds a predetermined threshold value; and in response to detecting application of the machine deceleration system when a speed of the machine exceeds a predetermined threshold value:

destroking the hydraulic pump and allowing the hydraulic motor to drive the hydraulic pump; and driving the one or more screed electrical heating elements with electrical power generated by the generator linked to the hydraulic pump, such that a current to the one or more screed electrical heating elements exceeds a current being provided to the one or more screed electrical heating elements at the time of detecting application of the machine deceleration system.

2. The method of assisting braking in a paving machine in accordance with claim 1, wherein the predetermined threshold value is a percentage of a maximum allowable machine speed.

3. The method of assisting braking in a paving machine in accordance with claim 1, wherein driving the one or more screed electrical heating elements with the electrical power generated by the generator comprises driving the one or more screed electrical heating elements in proportion to an amount by which the machine speed exceeds the predetermined threshold value.

4. The method of assisting braking in a paving machine in accordance with claim 1, wherein driving the one or more screed electrical heating elements with the electrical power generated by the generator comprises driving the one or more screed electrical heating elements at full power.

5. The method of assisting braking in a paving machine in accordance with claim 4, further comprising determining that application of the machine deceleration system has ceased and in response to determining that application of the machine deceleration system has ceased, reversing the destroking of the hydraulic pump and returning the current being provided to the one or more screed electrical heating elements to an operated commanded level.

6. The method of assisting braking in a paving machine in accordance with claim 1, wherein the paving machine includes a pulling tractor and a pulled screed assembly housing the one or more screed electrical heating elements.

7. The method of assisting braking in a paving machine in accordance with claim 6, wherein the screed assembly includes one or more screed extenders and wherein at least a subset of the one or more screed electrical heating elements reside in the one or more screed extenders.

8. A paving system for laying a paving material on a roadbed, the paving system comprising:

a tractor having an engine and a drive train, the drive train being driven by one or more hydraulic motors;

a hydraulic supply system driven by the engine, the hydraulic supply system including a hydraulic pump and one or more control valves for controlling the flow of hydraulic fluid to and from the one or more hydraulic motors;

a machine deceleration system actuatable by an operator command;

a screed assembly including one or more heating elements for heating the paving material;

an electrical generator configured to provide electrical power to the one or more heating elements; and a controller communicatively linked to the electrical generator, hydraulic supply system, and machine deceleration system, configured to cause energy to be transferred from the one or more hydraulic motors of the drive system to the hydraulic pump, from the hydraulic pump to the generator, and from the generator to the one or more heating elements in the event that the machine deceleration system is actuated when a speed of the machine exceeds a predetermined threshold.

9. The paving system for laying a paving material on a roadbed according to claim 8, wherein the controller is a computing device incorporating one or more microcontrollers or microprocessors.

10. The paving system for laying a paving material on a roadbed according to claim 8, wherein the generator is an alternating current generator.

11. The paving system for laying a paving material on a roadbed according to claim 8, wherein the generator is a direct current generator.

12. The paving system for laying a paving material on a roadbed according to claim 8, wherein the generator is linked to the one or more heating elements via one or more electrically actuated elements.

13. The paving system for laying a paving material on a roadbed according to claim 8, wherein the generator is remotely located relative to the tractor.

14. The paving system for laying a paving material on a roadbed according to claim 8, wherein the controller is remotely located relative to the tractor.

15. A tractor for pulling a paving screed having one or more electrically powered screed heater elements, the tractor comprising:

an engine and a drive train, the drive train being driven by one or more hydraulic motors;

a hydraulic supply system driven by the engine;

a machine deceleration system actuatable by an operator command;

an electrical generator configured to provide electrical power to the one or more heating elements; and a controller communicatively linked to the electrical generator, hydraulic supply system, and deceleration system, configured to cause energy to be transferred from the one or more hydraulic motors of the drive system to the hydraulic pump, from the hydraulic pump to the generator, and from the generator to the one or more heating elements in the event that actuation of the machine deceleration system occurs at a machine speed exceeding a predetermined threshold.

16. The tractor for pulling a paving screed according to claim 15, wherein the controller is configured to cause energy to be transferred from the one or more hydraulic motors of the drive system to the hydraulic pump, from the hydraulic pump to the generator, and from the generator to the one or more heating elements when the machine speed exceeds the predetermined threshold by commanding full power to the one or more heating elements.

17. The tractor for pulling a paving screed according to claim 15, wherein the controller is configured to cause energy to be transferred from the one or more hydraulic motors of the drive system to the hydraulic pump, from the hydraulic pump to the generator, and from the generator to the one or more heating elements when the machine speed exceeds the predetermined threshold by commanding additional power to the one or more heating elements, wherein the additional power is a function of the difference between the predetermined threshold and the machine speed.

18. The tractor for pulling a paving screed according to claim 15, wherein the predetermined threshold value is a percentage of a maximum allowed machine speed.

19. The tractor for pulling a paving screed according to claim 15, further including one or more relays to link the generator to the one or more heating elements.

* * * * *